US010582823B2

(12) United States Patent
Hooley et al.

(10) Patent No.: US 10,582,823 B2
(45) Date of Patent: Mar. 10, 2020

(54) VACUUM CLEANER INCLUDING A SURFACE CLEANING HEAD HAVING A DISPLAY

(71) Applicant: TTI (Macao Commercial Offshore) Limited, Macau (MO)

(72) Inventors: Bradley Hooley, Charlotte, NC (US); Benjamin Shrader, Newton, NC (US); Doug Rukavina, Concord, NC (US)

(73) Assignee: TTI (Macao Commercial Offshore) Limited, Praia Grande (MO)

( * ) Notice: Subject to any disclaimer, the term of this patent is extended or adjusted under 35 U.S.C. 154(b) by 110 days.

(21) Appl. No.: 15/910,874

(22) Filed: Mar. 2, 2018

(65) Prior Publication Data

US 2018/0249875 A1 Sep. 6, 2018

Related U.S. Application Data

(60) Provisional application No. 62/466,511, filed on Mar. 3, 2017.

(51) Int. Cl.
*A47L 9/28* (2006.01)
*A47L 5/26* (2006.01)
(Continued)

(52) U.S. Cl.
CPC ..... *A47L 9/2857* (2013.01); *A47L 5/225* (2013.01); *A47L 5/26* (2013.01); *A47L 5/30* (2013.01);
(Continued)

(58) Field of Classification Search
CPC ..... A47L 9/2857; A47L 9/28; A47L 9/248; A47L 5/32; A47L 5/30; A47L 9/0477;
(Continued)

(56) References Cited

U.S. PATENT DOCUMENTS 2,045,496 A 6/1936 Skinner
3,766,595 A 10/1973 Valbona et al.
(Continued)

FOREIGN PATENT DOCUMENTS

JP 2007167154 7/2007
WO 2013134637 A1 9/2013
WO 201413106 9/2014

OTHER PUBLICATIONS

International Search Report and Written Opinion for Application No. PCT/US2018/020742 dated Aug. 10, 2018, 12 pages.
(Continued)

*Primary Examiner* — David Redding
(74) *Attorney, Agent, or Firm* — Michael Best & Friedrich LLP

(57) ABSTRACT

A vacuum cleaner includes a surface cleaning head, a pivot assembly pivotally coupled to the surface cleaning head such that the pivot assembly is pivotable relative to the surface cleaning head, and a canister assembly coupled to the pivot assembly such that the canister assembly is supported above the surface cleaning head. The pivot assembly pivotally couples to the surface cleaning head such that the pivot assembly is pivotable relative to the surface cleaning head. The canister assembly includes an electrical source connector configured to connect to a power source. The electrical source connector is electrically connected to a plurality of electrical components via a pivot assembly electrical connection. The surface cleaning head further includes an appliance board having an appliance controller, a display board having a display, and a floor-type sensor, each of which being one of the plurality of electrical components.

10 Claims, 10 Drawing Sheets

(51) Int. Cl.

| | |
|---|---|
| ***A47L 9/32*** | (2006.01) |
| ***A47L 5/22*** | (2006.01) |
| ***A47L 9/04*** | (2006.01) |
| ***A47L 5/30*** | (2006.01) |
| ***A47L 5/32*** | (2006.01) |
| ***A47L 9/24*** | (2006.01) |

(52) U.S. Cl.
CPC ..... *A47L 5/32* (2013.01); *A47L 9/0477* (2013.01); *A47L 9/248* (2013.01); *A47L 9/28* (2013.01); *A47L 9/2821* (2013.01); *A47L 9/2826* (2013.01); *A47L 9/2868* (2013.01); *A47L 9/2894* (2013.01); *A47L 9/325* (2013.01)

(58) Field of Classification Search
CPC ..... A47L 5/225; A47L 9/2894; A47L 9/2868; A47L 9/2826; A47L 9/325; A47L 9/2821; A47L 5/26
USPC ..... 15/319
See application file for complete search history.

(56) References Cited

U.S. PATENT DOCUMENTS

| | | | | |
|---|---|---|---|---|
| 3,936,904 | A | 2/1976 | Bashark | |
| 4,199,838 | A | 4/1980 | Simonsson | |
| 4,767,213 | A | 8/1988 | Hummel | |
| 4,817,234 | A | 4/1989 | Greulich | |
| 5,023,973 | A | 6/1991 | Tsuchida et al. | |
| 5,033,151 | A | 7/1991 | Kraft et al. | |
| 5,301,385 | A | 4/1994 | Abe et al. | |
| 5,400,463 | A | 3/1995 | Attard et al. | |
| 5,507,067 | A | 4/1996 | Hoekstra et al. | |
| 5,542,146 | A | 8/1996 | Hoekstra et al. | |
| 5,868,710 | A | 2/1999 | Battiato et al. | |
| 6,026,539 | A | 2/2000 | Mouw et al. | |
| 6,029,309 | A | 2/2000 | Imamura | |
| 6,167,588 | B1 | 1/2001 | Dyson | |
| 6,571,422 | B1 | 6/2003 | Gordon et al. | |
| 6,646,626 | B1 | 11/2003 | Uskali et al. | |
| 6,800,140 | B2 | 10/2004 | Hansen | |
| 7,143,467 | B2 | 12/2006 | Seith | |
| 7,170,534 | B2 | 1/2007 | Son et al. | |
| 7,174,604 | B2 | 2/2007 | Yoo et al. | |
| 7,220,930 | B2 * | 5/2007 | Gordon | A47L 9/2805 15/339 |
| 7,418,763 | B2 | 9/2008 | Shaver et al. | |
| 7,424,766 | B2 * | 9/2008 | Reindle | A47L 9/2842 15/319 |
| 7,461,430 | B2 | 12/2008 | Reick-Mitrisin et al. | |
| 7,509,707 | B2 | 3/2009 | Pullins | |
| 7,673,368 | B2 | 3/2010 | Cloud, III | |
| 7,690,077 | B2 | 4/2010 | Biere | |
| 7,898,429 | B2 | 3/2011 | Hwang et al. | |
| 7,913,353 | B2 | 3/2011 | Park et al. | |
| 8,726,457 | B2 | 5/2014 | Liu et al. | |
| 9,364,127 | B2 | 6/2016 | Conrad | |
| 9,814,361 | B2 * | 11/2017 | Bilger | A47L 5/225 |
| 2002/0126110 | A1 | 9/2002 | Bowron | |
| 2005/0236012 | A1 | 10/2005 | Josefsson et al. | |
| 2006/0203014 | A1 | 9/2006 | Lev et al. | |
| 2007/0067948 | A1 | 3/2007 | Biere | |
| 2007/0100282 | A1 | 5/2007 | Small et al. | |
| 2007/0214596 | A1 | 9/2007 | Bax | |
| 2007/0214597 | A1 | 9/2007 | Suzuki | |
| 2008/0016646 | A1 | 1/2008 | Gagnon et al. | |
| 2008/0109985 | A1 | 5/2008 | Park et al. | |
| 2009/0101047 | A1 | 4/2009 | Mulaw et al. | |
| 2009/0109242 | A1 | 4/2009 | Kuo et al. | |
| 2009/0167653 | A1 | 7/2009 | Lin | |
| 2009/0174658 | A1 | 7/2009 | Blatchley et al. | |
| 2009/0201165 | A1 | 8/2009 | Hwang et al. | |
| 2010/0031823 | A1 | 2/2010 | Cowie et al. | |
| 2010/0318232 | A1 * | 12/2010 | Tiekoetter | A47L 9/02 700/282 |
| 2017/0000305 | A1 * | 1/2017 | Gordon | A47L 5/362 |

OTHER PUBLICATIONS

Windsor, "Sensor S, 12 and 15 inch Upright Vacuums," 2009, 2 pages.
Windsor, "Sensor S12 Manual," 2002, 10 pages.
Windsor, "Sensor SR12 Manual and Website," accessed Jul. 28, 2010, 20 pages.
Windsor, "Sensor XP 12, 15 and 18 inch Upright Vacuums," 2008, 4 pages.

* cited by examiner

VACUUM CLEANER INCLUDING A SURFACE CLEANING HEAD HAVING A DISPLAY

CROSS-REFERENCE TO RELATED APPLICATIONS

This application claims priority to U.S. Provisional Patent Application No. 62/466,511, filed Mar. 3, 2017, the entire contents of which are hereby incorporated by reference herein.

BACKGROUND

The present invention relates to a vacuum cleaner including a surface cleaning head having a display.

Upright vacuum cleaners are typically used to clean floor surfaces, such as carpeting. These types of vacuum cleaners, however, can be difficult to maneuver and operate in relatively confined areas. In addition, it is sometimes desirable to clean elevated surfaces, such as drapes, furniture, or steps, with an upright vacuum cleaner.

SUMMARY

In one embodiment, a vacuum cleaner includes a surface cleaning head, a pivot assembly pivotally coupled to the surface cleaning head such that the pivot assembly is pivotable relative to the surface cleaning head, and a canister assembly coupled to the pivot assembly such that the canister assembly is supported above the surface cleaning head. The pivot assembly pivotally couples to the surface cleaning head such that the pivot assembly is pivotable relative to the surface cleaning head. The pivot assembly includes a pivot assembly electrical connection. The pivot assembly electrical connection is electrically connected to a plurality of electrical components of the surface cleaning head. The canister assembly includes an electrical source connector configured to connect to a power source. The canister assembly further includes a dirt separation unit and a suction source electrically connected to the electrical source connector and in fluid communication with a dirty air inlet of the surface cleaning head and the dirt separation unit. The electrical source connector is electrically connected to the plurality of electrical components via the pivot assembly electrical connector. The surface cleaning head further includes an appliance board having an appliance controller, a display board having a display, and a floor-type sensor, each of which being one of the plurality of electrical components. The floor-type sensor and the display being in electrical communication with the appliance controller.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
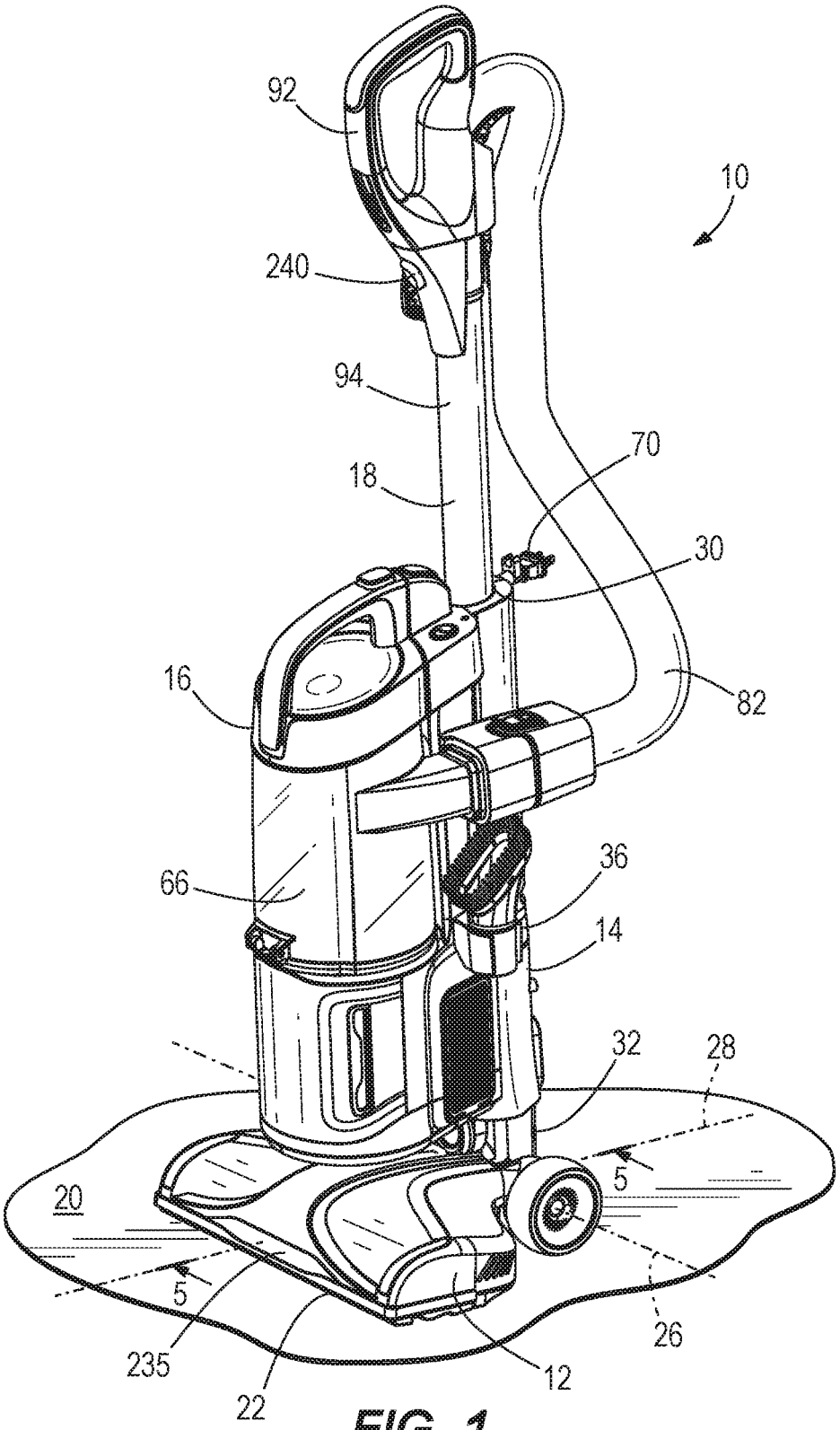
FIG. 1 is a perspective view of a vacuum cleaner according to an embodiment of the invention.

FIG. 1 illustrates an exemplary vacuum cleaner 10. The vacuum cleaner 10 includes a surface cleaning head 12, a pivot assembly 14, and a canister assembly 16. The vacuum cleaner 10 further includes a cleaning wand 18. Optionally, the canister assembly 16 is removably coupled to the cleaning head 12 and the pivot assembly 14. The cleaning wand 18 is removable from the pivot assembly 14 so that the canister assembly 16 and the cleaning wand 18 can be used for vacuuming apart from the cleaning head 12 and the pivot assembly 14.

In the illustrated embodiment of the vacuum cleaner 10 of FIG. 1, the surface cleaning head 12 is movable along a surface 20 to be cleaned, such as a carpeted or hard-surface floor. The cleaning wand 18 allows a user to move the surface cleaning head 12 along the surface 20. The cleaning wand 18 is also movable relative to the surface cleaning head 12 between an upright position (FIG. 1) and an inclined position.

In one embodiment, electrical power is supplied to the cleaning head 12 via the cleaning wand 18. In another embodiment, electrical power is supplied to the cleaning head 12 via a connection between the canister assembly 16 and the pivot assembly 14. However, in both embodiments, the electrical connections allow for easy removal of the wand 18 and provide easy reattachment of the wand 18 to provide electrical power to the cleaning head 12. In one embodiment, the canister assembly 16 is removably coupled to the cleaning head 12 and the pivot assembly 14. When the canister assembly is removable, the electrical connections allow for easy removal and reattachment of the canister assembly.

Figure 7:
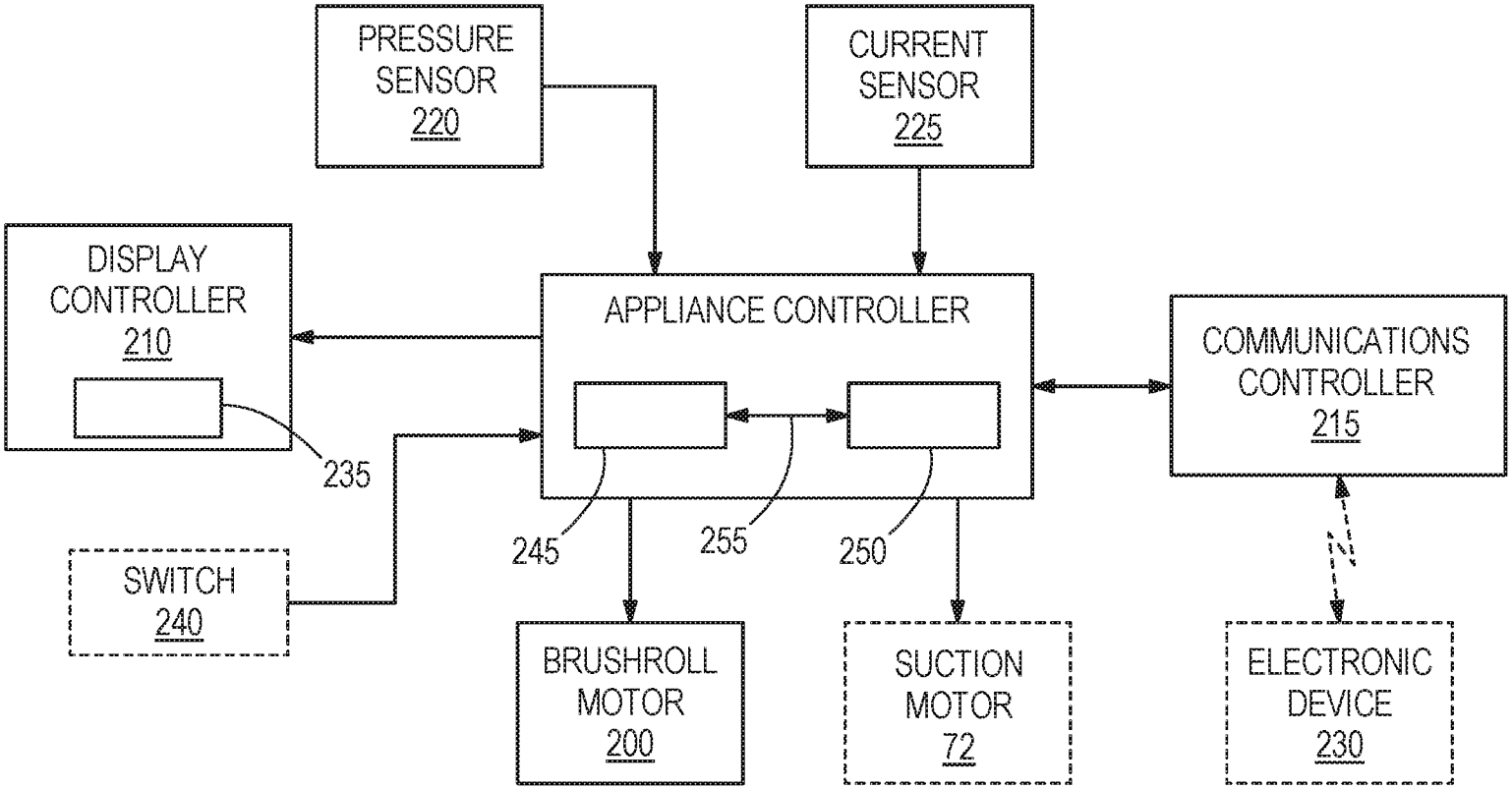
FIG. 7 is a block diagram of a portion of the electrical components of a vacuum cleaner system including the vacuum cleaner of FIG. 1.

The surface cleaning head 12 includes a dirty air inlet 22 and an electrical component. The electrical component can include a plurality of electrical components that can be used in the cleaning head of a vacuum cleaner. For example, in one embodiment, the electrical components include a brushroll motor 200 (FIG. 7) that drive a brushroll (also referred to as brush) 27 that agitates the surface 20 being cleaned. In other embodiments, the electrical components may include a controller, such as an appliance controller 205, a display controller 210, or a communications controller 215 for the vacuum 10. In yet other embodiments, the electrical components can include a sensor, such as a floor-type sensor (e.g., a pressure sensor 220), and a brushroll motor sensor (e.g., an electrical current sensor 225). In some embodiments, these sensors are used to determine whether there is a clog in the vacuum cleaner 10 or determine a type of surface 20 the cleaning head 12 is moving along.

The appliance controller 205 includes combinations of software and hardware that are operable to, among other things, control the operation of the vacuum 10 or any component of the vacuum, control the communication with an electronic device 230 via the communications controller 215, receive input from the sensors 220 and 225, receive input or provide output with a user interface (e.g., a display 235 and a control switch 240), and/or control the motors 200 and 72.

In one construction, the appliance controller 205 includes a printed circuit board 206 ("PCB") that is populated with a plurality of electrical and electronic components that provide, power, operational control, and protection to the vacuum 10. In some constructions, the PCB includes, for example, a processing unit 245 (e.g., a microprocessor, a microcontroller, or another suitable programmable device), a memory 250, and a bus 255. The bus 255 connects various components of the PCB including the memory 250 to the processing unit 245. The memory 250 includes, for example, a read-only memory ("ROM"), a random access memory ("RAM"), an electrically erasable programmable read-only memory ("EEPROM"), a flash memory, or another suitable magnetic, optical, physical, or electronic memory device. The processing unit 245 is connected to the memory 250 and executes instructions (e.g., software) that is capable of being stored in the RAM (e.g., during execution), the ROM (e.g., on a generally permanent basis), or another non-transitory computer readable medium such as another memory or a disc. Additionally or alternatively, the memory 250 is included in the processing unit 245 (e.g., as part of a microcontroller).

Software included in this implementation of the vacuum cleaner 10 is stored in the memory 250 of the appliance controller 245. The software includes, for example, firmware, program data, one or more program modules, and other executable instructions. The appliance controller 245 is configured to retrieve from memory and execute, among other things, instructions related to the control processes and methods described herein.

The PCB also includes, among other things, a plurality of additional passive and active components such as resistors, capacitors, inductors, integrated circuits, and amplifiers. These components are arranged and connected to provide a plurality of electrical functions to the PCB including, among other things, signal conditioning or voltage regulation. For descriptive purposes, the PCB and the electrical components populated on the PCB are collectively referred to as the controller 100.

Figure 11:
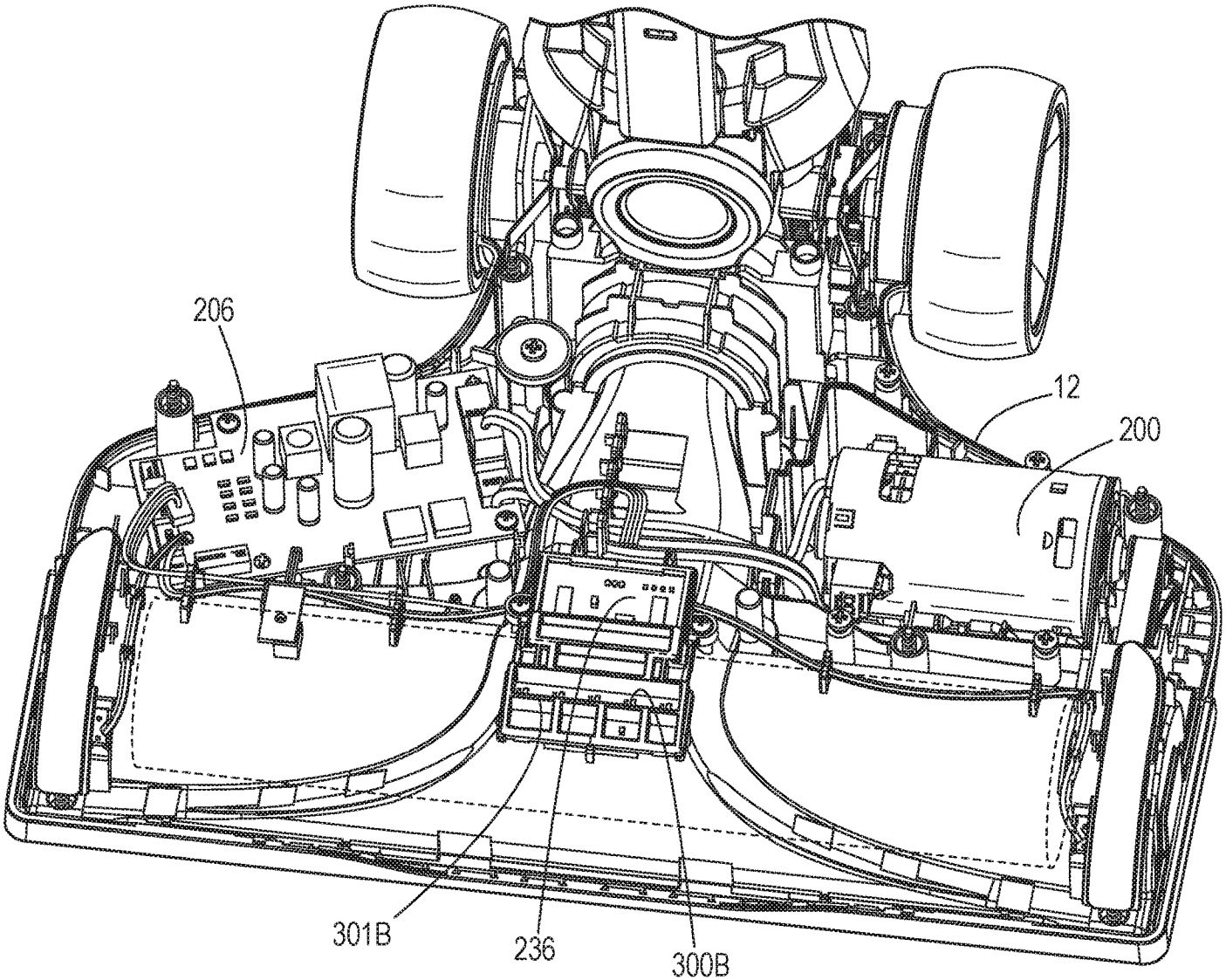
FIG. 11 is a perspective view of a surface cleaning head of the vacuum cleaner of FIG. 1 with a portion of the housing of the surface cleaning head removed.

The user interface is included to control the vacuum cleaner 10. The user interface can include a combination of digital and analog input devices required to control the vacuum 10. For example, the user interface can be include a display 235 (mounted on the display controller 210) and a switch 240, or the like. The display 235 can be as simple is an LED or LCD display indicating operation of the vacuum cleaner 10 and the switch 240 can be used for activating/deactivating the vacuum cleaner 10. FIG. 1 shows a display 235 and a switch 240. The display 235 can be mounted on a PCB 236 (FIG. 11) with other additional passive and active components necessary for controlling the display, similar to what was discussed for the appliance controller 205.

Figure 8:
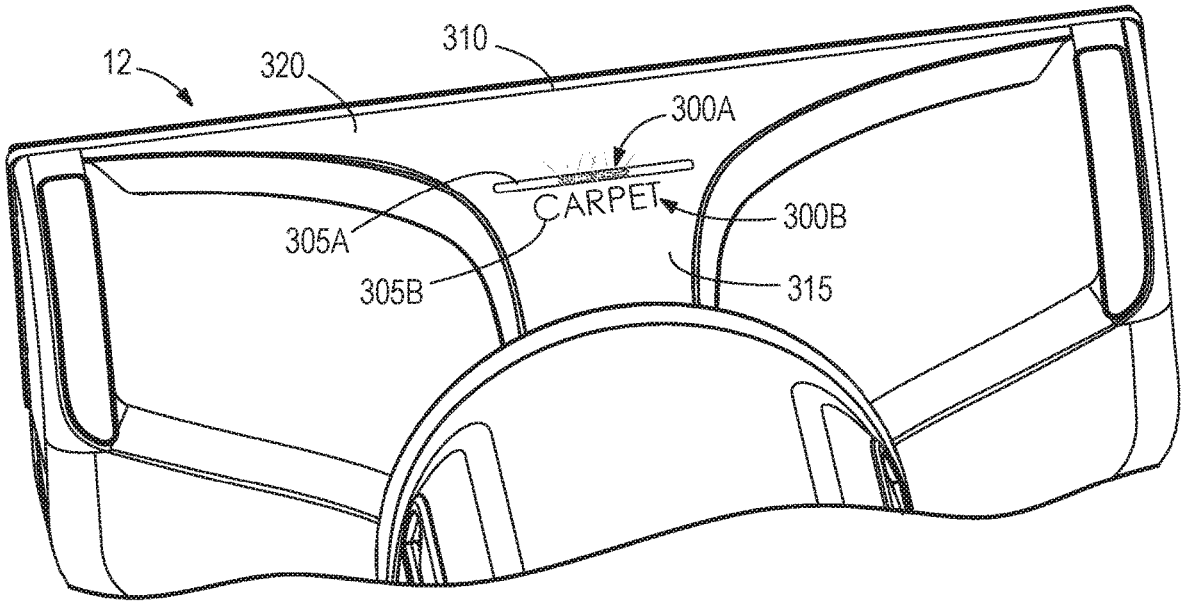
FIG. 8 is top view of a portion of the vacuum cleaner of FIG. 1 showing an indicator during operation.
Figure 9:
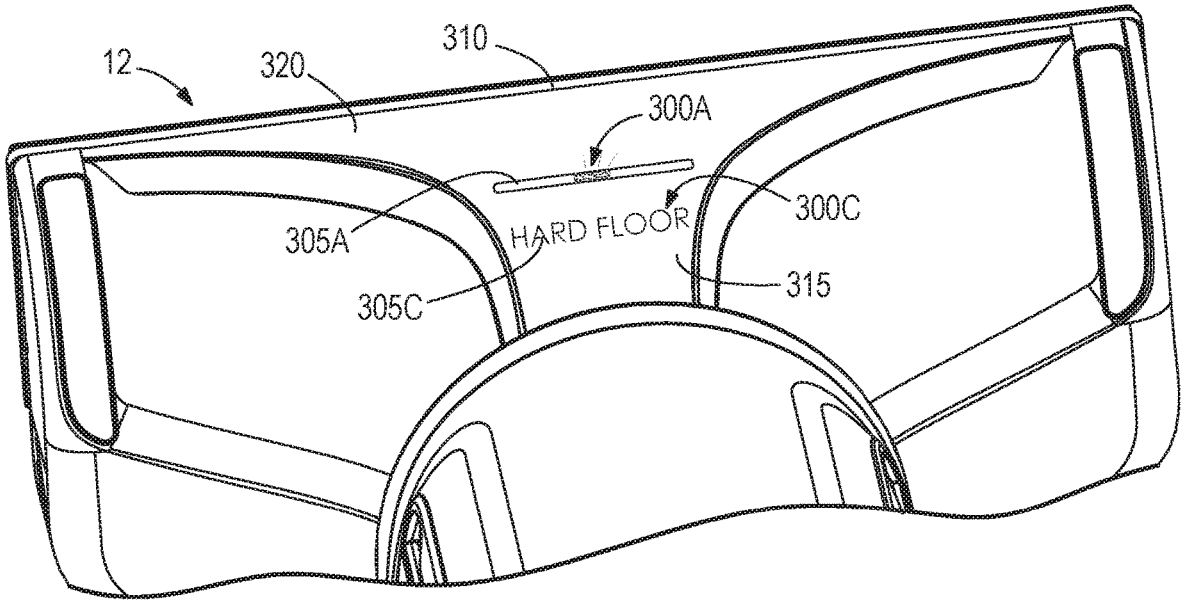
FIG. 9 is top view of a portion of the vacuum cleaner of FIG. 1 the indicator during operation.
Figure 10:
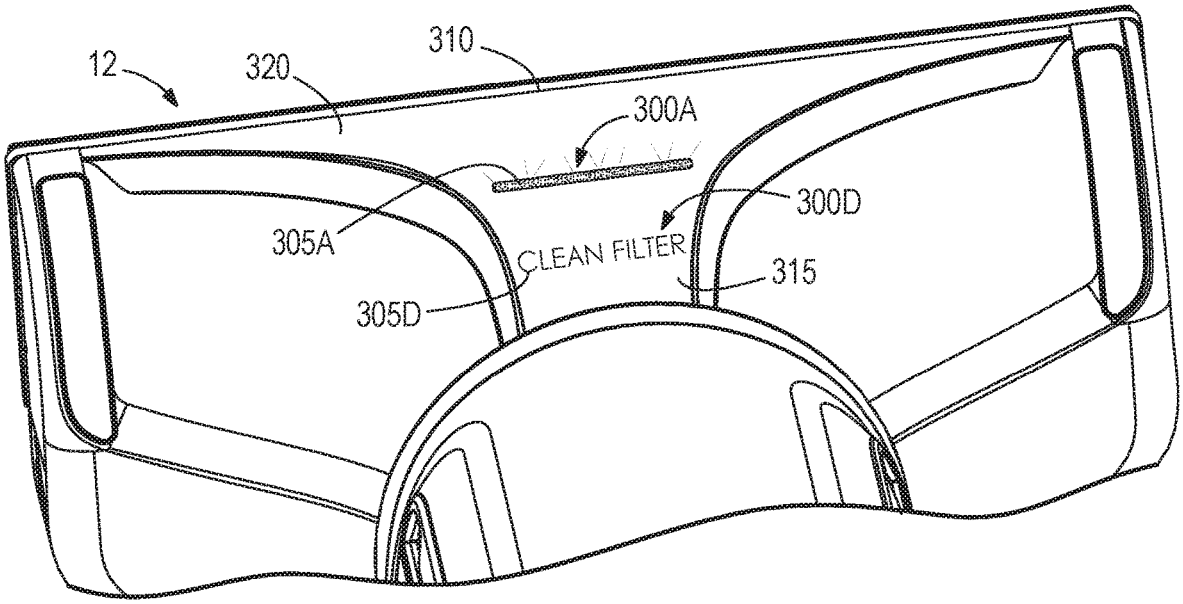
FIG. 10 is top view of a portion of the vacuum cleaner of FIG. 1 showing the indicator during operation.

FIGS. 8-10 show a display having a plurality of LEDs 300A-300D working with indicators 305A-305D formed in a panel 310 of the surface cleaning head 12. The indicators 305A-D are words (or symbols) of clear plastic formed in a black panel 315 so that when a series of LEDs 300A-300D light positioned behind the indicators 305A-305D the LEDs 300A-300D illuminate the indicators 305A-305D through the black panel 315. The black panel 315 is insert molded into the outer housing 320 of the surface cleaning head 12. Each LED or series of LEDs 300A, 300B, 300C, or 300D are positioned in a box (e.g., box 301B shown in FIG. 11) that is sealed against the inside of the outer housing 320 around the indicator 305A, 305B, 305C, or 305D, respectively, such that light shines through the clear plastic forming the word or symbol, but the activated LEDs 300A, 300B, 300C, or 300D do not illuminate other indicators 305A, 305B, 305C, or 305D not activated. Therefore, the indicators 305A, 305B, 305C, or 305D not activated appear to be black because the view through the clear word is into a dark box.

The appliance controller 205 may operate the suction motor 72 (of the canister assembly 16) based on a floor type. For example, the controller 100 may operate the suction motor 72 at a lower power on a hard floor surface to conserve energy or a higher power on a hard floor surface to increase debris pick-up. In some embodiments, the suction motor 72 may be operated at a lower power on certain height carpets to reduce the clamp-down of the nozzle to the carpet so that the vacuum cleaner 10 is easier to push.

The brushroll sensor refers to a sensor that senses a parameter related directly or indirectly to an aspect of the brushroll 27. The brushroll sensor can be a tachometer for sensing a revolutions per minute (RPM) value of the brushroll 27, a tachometer for sensing an RPM value of the brushroll motor 200, an electrical sensor 225 for sensing an electrical parameter (e.g., current or voltage) of the brushroll motor 200, a torque sensor for sensing a torque parameter of the brushroll motor 200, etc. The floor type sensor refers to a sensor that senses a parameter related directly or indirectly to an aspect of the type of flow. The floor type sensor can be a pressure sensor 220 for sensing a pressure within the vacuum 10, a current sensor 225 for sensing a current of the brushroll motor 200, and so. It is envisioned that the number of sensors 220 and 225 can be greater than only the two sensors shown. For example, the floor type sensor may require signals from both the pressure sensor 220 and the motor current sensor 225 to determine a parameter relating to a floor type. It is also envisioned that a sensor can provide information (e.g., signals, data) applicable to both the brushroll sensor and the floor type sensor. For example, a motor current sensor 225 may provide information for both a brushroll parameter and a floor type parameter.

The communications controller 215 provides wireless communication to the electronic device 230. The communications controller 215 includes a receiver circuit and a transmitter circuit, both of which are electrically connected to an antenna. Of course the receiver circuit and the transmitter circuit may be part of a transceiver. The communications controller 225 may communicate with the electronic device 230 via conventional modes of transmission (e.g., IR and/or RF) and via conventional protocols/standards of communication (e.g., Bluetooth™, WiFi™). It is also envisioned that that the communications controller 225 can communicate with other devices (e.g., other computers, remote servers) directly or indirectly (e.g., over one or more networks).

In one implementation, the vacuum cleaner 10 further includes a current sensor a pressure sensor 220, and an appliance controller 205 in communication with the sensors. The current sensor 225 is configured to sense a current draw of the brushroll motor 200. The appliance controller 205 receives and analyzes signals from the pressure sensor 220 and the current sensor 225 and control the rotational speed of the brushroll motor 200. The appliance controller 200 receives the signals from the sensors and compares the sensed pressure from the pressure sensor and the sensed current and from the current sensor 225 with one or more corresponding predetermined thresholds. The predetermined thresholds (i.e., pressure, torque, and/or current) are associated with different floor types to represent a distinction between floor surfaces (e.g., carpet and hard floor). The appliance controller 205 determines the floor surface by comparing the sensed pressure and/or the sensed motor current and/or torque values with the predetermined thresholds, and automatically operates the brushroll motor 200, and optionally the suction motor 72, in a manner optimized for the type of floor surface. For example, a high-pile carpet will generally cause high suction (i.e., low pressure) within the dirty air inlet 22 and force the brushroll motor 200 to work harder (i.e., generate higher torque and draw more current), while a hard floor surface will lead to lower suction (i.e., higher pressure that is closer to atmospheric pressure) within the dirty air inlet 22 and will allow the brushroll motor 200 to work more easily (i.e., generate lower torque and draw less current).

The pivot assembly 14 is pivotally coupled to the cleaning head 12. The pivot assembly 14 pivots about the first axis 26 to rotate the canister assembly 16 and the pivot assembly 14 between an upright position (FIG. 1) and in inclined operation position. The pivot assembly 14 pivots about the second axis 28 to facilitate steering the vacuum cleaner 10 while in use.

Figure 4:
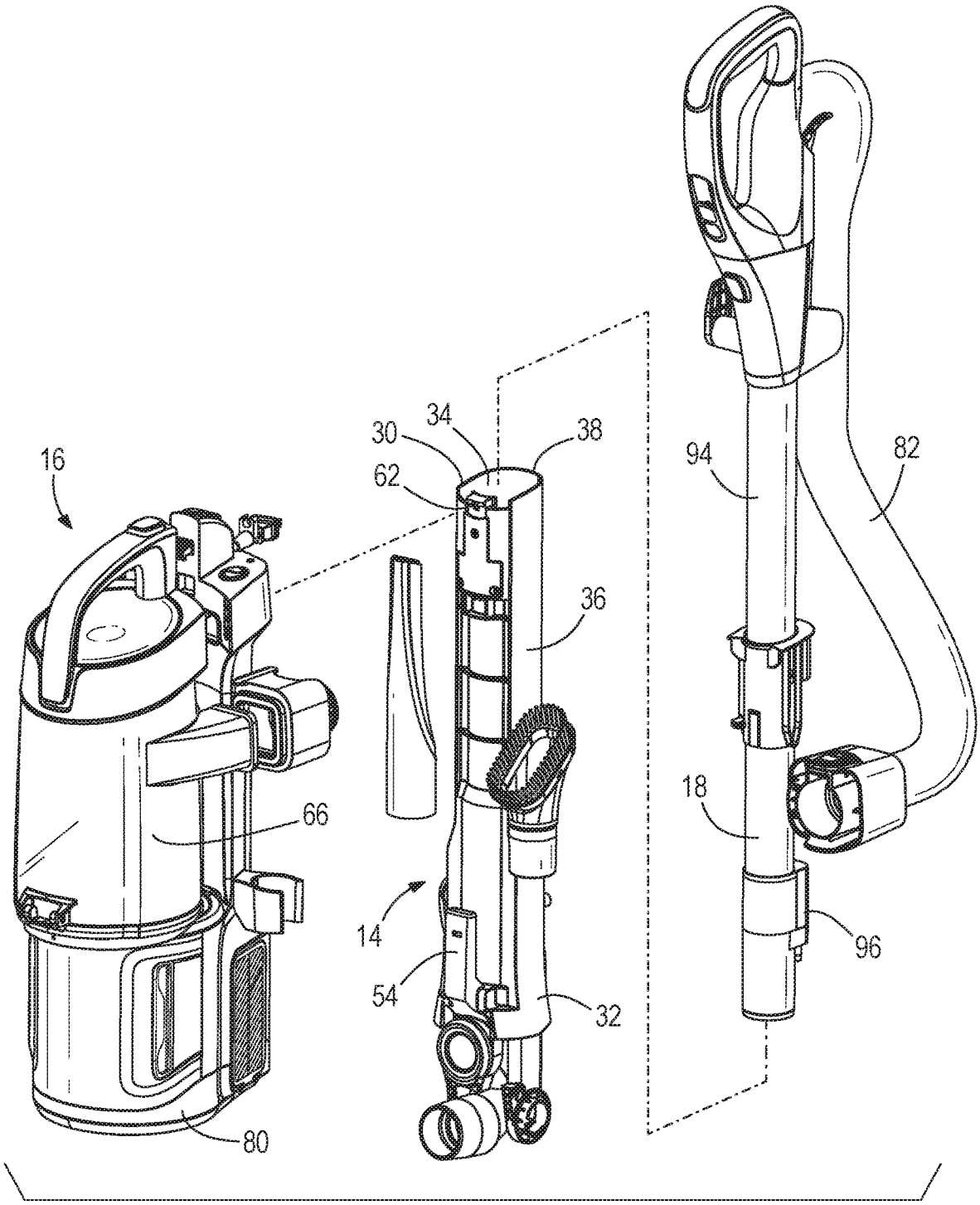
FIG. 4 is a partially exploded view of the vacuum cleaner of FIG. 1.

Referring to FIG. 4, the pivot assembly 14 includes an upper end 30, a lower end 32, an interior 34 and an exterior 36. The cleaning head 12 is coupled to the pivot assembly 14 adjacent the lower end 32. The upper end 30 includes an aperture 38. The interior 34 is generally hollow and the aperture 38 and the interior 34 receives the cleaning wand 18. The exterior 36 includes a recess 40 (FIG. 2).

Figure 2:
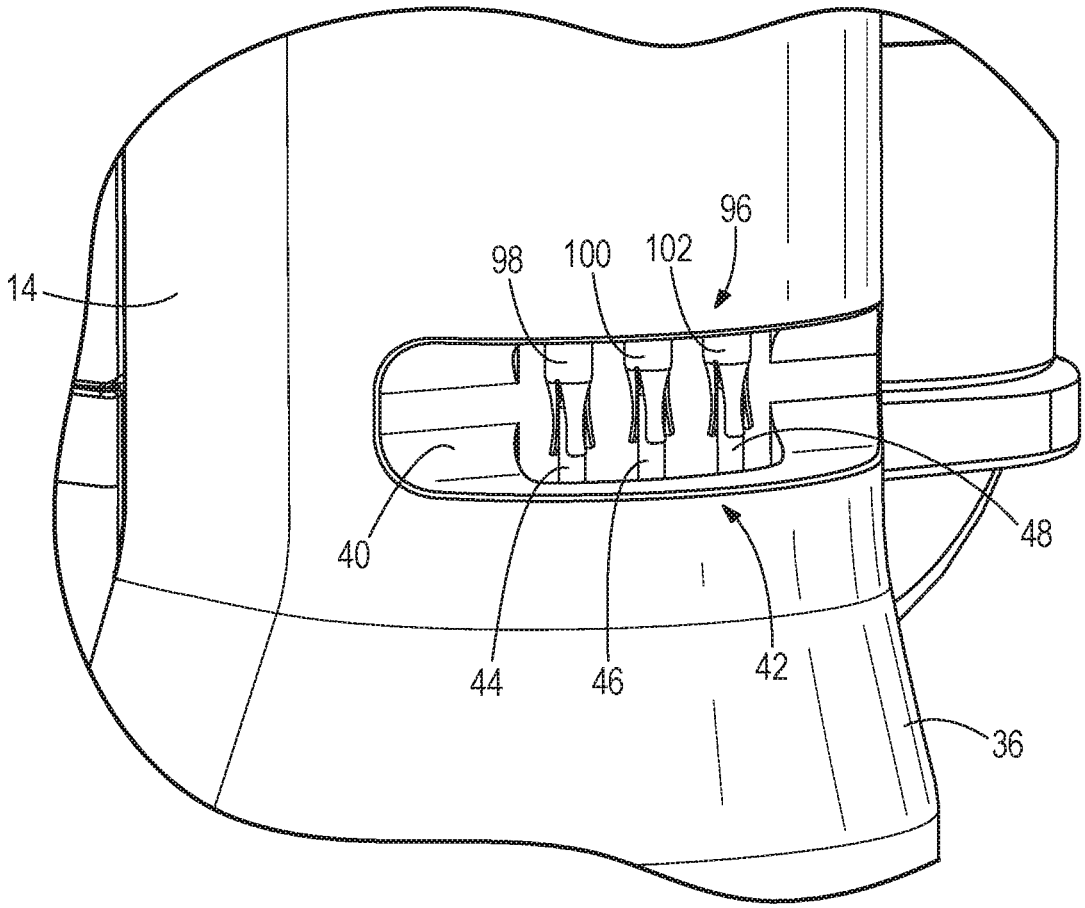
FIG. 2 is an enlarged perspective view of a portion of the vacuum cleaner of FIG. 1.

With continued reference to FIG. 2, the pivot assembly electrical connection further includes an electrical connector 42 located in the recess 40 of the exterior 36 of the pivot assembly. The electrical connector 42 is electrically connected (e.g., by wires) to the plurality of electrical components of the cleaning head 12. The illustrated electrical connector 42 includes a power terminal 44, a ground terminal 46, and a communication terminal 48. Although the illustrated electrical connector 42 includes three terminals, in other embodiments, the electrical connector may include more or less than three terminals. Also, although the illustrated electrical connector 42 is a pin type electrical connector, in other embodiments other types of electrical connectors can be utilized.

Figure 3:
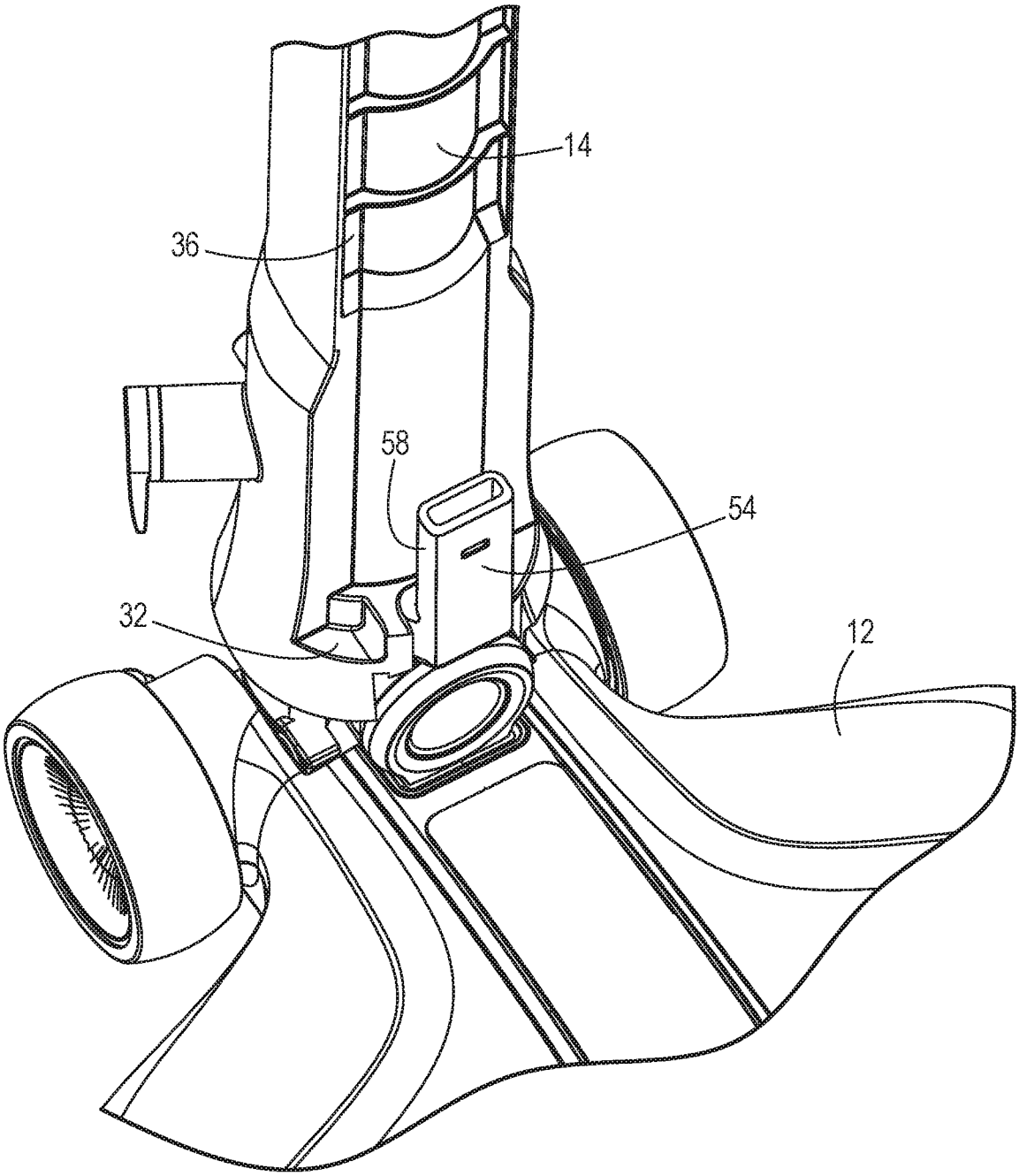
FIG. 3 is a perspective view of a portion of the vacuum cleaner of FIG. 1 with a canister assembly removed.
Figure 6:
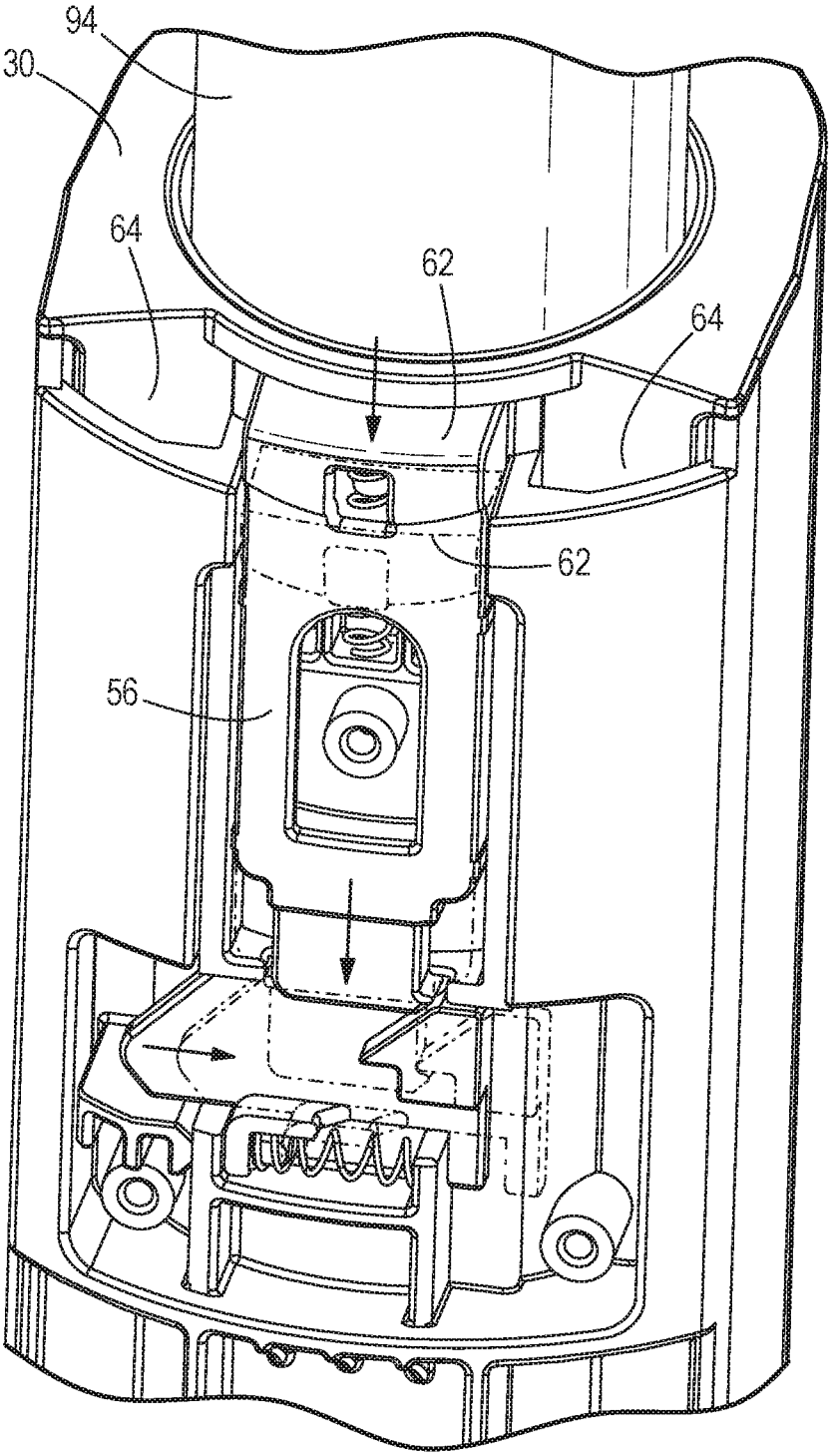
FIG. 6 is a perspective view of a portion of the vacuum cleaner of FIG. 1 with the canister assembly removed.

The cleaning wand 18 is received in the interior 34 of the pivot assembly 4 and removed from the interior 34 by sliding the cleaning wand 18 through the aperture 38 along a longitudinal axis 52. In the embodiment illustrated in FIGS. 3 and 6, the pivot assembly 14 further includes a latch 56 that removably couples the cleaning wand 18 to the pivot assembly 14. The pivot assembly 14 includes an elongated projection 54 that removably couples the canister assembly 16 to the pivot assembly 14.

Figure 5:
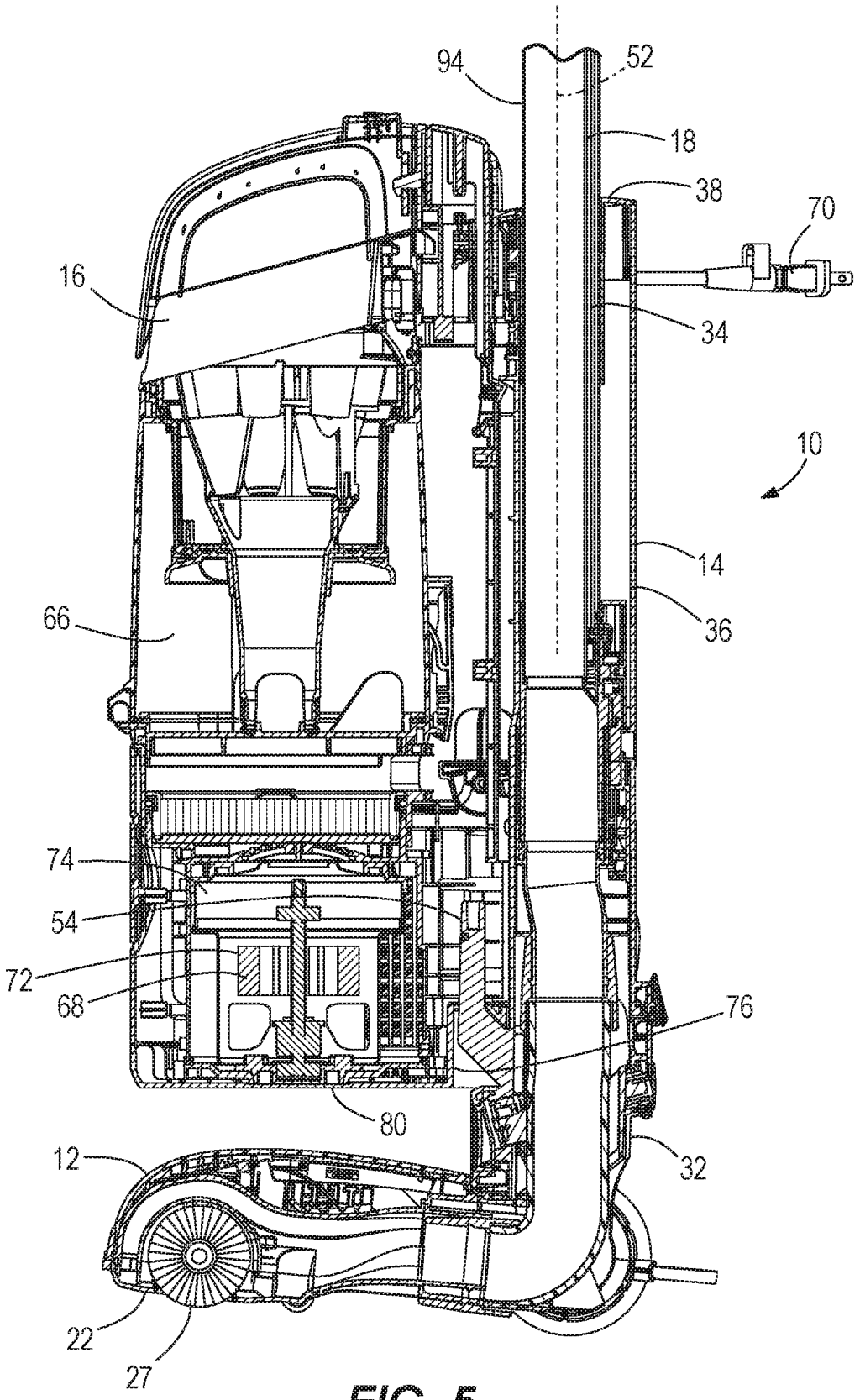
FIG. 5 is a cross-sectional view of the vacuum cleaner of FIG. 1.

Referring to FIGS. 4 and 5, the canister assembly 16 includes a dirt separation unit 66, a suction source 68, and an electrical source connector 70. The electrical source connector 70 connects to a power source (e.g., electrical outlet) to provide power to the vacuum cleaner 10, including the suction source 68. In the illustrated embodiment, the electrical source connector 70 includes an AC power cord. However, in other embodiments, the electrical source connector 70 may include other types of electrical source connectors, such as battery terminals that connect to a battery (e.g., lithium ion rechargeable battery) that is coupled to the vacuum cleaner. The dirt separation unit 66 is in fluid communication with the suction source 68 such that the suction source 68 is operable to generate a suction airflow through the dirty air inlet 22 and through the dirt separation until 66. In the illustrated embodiment, the dirt separation unit 66 includes a cyclonic dirt separation unit. In other embodiments, other types of dirt separation units can be utilized, such as filters and/or filter bags. The suction source 68 includes a motor 72 and a fan 74.

Referring to FIG. 1, the vacuum cleaner 10 further includes a flexible hose 82 in fluid communication with the dirt separation unit 66, the cleaning wand 18, and the dirty air inlet 22. Debris and the suction airflow enter the dirt separation unit 66 through the flexible hose 82. In the illustrated embodiment, the hose 82 includes a helical spring wire, a power wire, a ground wire, and a communication wire helically arranged adjacent the spring wire. The cleaning wand 18 is at an end of the hose 82 opposite the dirt separation unit 66.

The cleaning wand 18 includes a handle 92 and a rigid conduit 94. Referring to FIGS. 2 and 4, the wand 18 further includes a cleaning wand electrical connector 96 adjacent an end of the conduit 94 opposite the handle 92. The illustrated cleaning wand electrical connector 96 includes a power terminal 97, a ground terminal 98, and a communication terminal 99. The terminals 98, 100, and 102 are electrically connected to the corresponding wire (i.e., power wire, ground wire, and communication wire) of the hose 82. The power and ground wires of the hose 82 are electrically coupled to the electrical source connector 70 of the canister assembly 16. The communication wire of the hose 82 can be electrically connected a sensor, such as a pressure sensor or electrical current sensor, of the canisters assembly 16. The illustrated terminals 98, 100, and 102 of the cleaning wand 18 are socket terminals that receive the pin terminals 44, 46, and 48, respectively, of the pivot assembly 14 as illustrated in FIG. 2.

Referring to FIGS. 1 and 5, in operation, the vacuum cleaner 10 can be used with the canister assembly 16 attached to the pivot assembly 14 in the configuration illustrated in FIGS. 1 and 5. Debris and the suction airflow are drawn through the dirty air inlet 22, travels through the pivot assembly 14, conduit 94 of the wand 18, through the hose 82, and into the dirt separation unit 66. Debris is separated from the airflow and the debris remains in the dirt separation unit 66 while the relatively clean suction airflow travels through the suction source 68 before being exhausted from the canister assembly 16. Power is supplied to the suction source 68 from the electrical source connector 70. Power is supplied to the electrical component of the cleaning head 12 by the power and ground wires of the hose 82, the wand electrical connector 96, and the pivot assembly electrical connector 42, which is electrically connected to the electrical component of the cleaning head 12. In one embodiment, the primary controller of the vacuum 10 is located in the cleaning head 12. Sensor(s) in the canister assembly 16 are communicatively coupled to the controller via the communication terminal 48 of the pivot assembly electrical connector 42, the communication terminal 102 of the wand 18, and the communication wire of the hose 82.

During operation of the vacuum 10, it may be useful to remove the cleaning wand 18 from the interior 34 of the pivot assembly 14, for example, for above-floor cleaning. To remove the wand 18, the user pulls the handle 92 generally along the longitudinal axis 52 of the pivot assembly 14. The connection between the wand electrical connector 96 and the pivot assembly electrical connector 42 allows for easy disconnection and removal of the wand 18. The wand electrical connector 96 allows the user to electrically and communicatively connect the wand 18 and the vacuum 10 to an accessory tool to provide electrical power and control to the accessory tool.

Various features and advantages of the invention are set forth in the following claims.

What is claimed is:

1. A vacuum cleaner comprising:

a surface cleaning head including a dirty air inlet and a plurality of electrical components;

a pivot assembly pivotally coupled to the surface cleaning head such that the pivot assembly is pivotable relative to the surface cleaning head, the pivot assembly including a pivot assembly electrical connection being electrically connected to the plurality of electrical components of the surface cleaning head;

a canister assembly coupled to the pivot assembly such that the canister assembly is supported above the surface cleaning head, the canister assembly including an electrical source connector configured to connect to a power source, the canister assembly further including a dirt separation unit and a suction source electrically connected to the electrical source connector and in fluid communication with the dirty air inlet and the dirt separation unit, the electrical source connector being electrically connected to the plurality of electrical components via the pivot assembly electrical connection; and a cleaning wand in fluid communication with the dirt separation unit and removably coupled to the pivot assembly, the cleaning wand including a handle and a cleaning wand electrical connector, the cleaning wand received within the interior of the pivot assembly to removably couple the cleaning wand to the pivot assembly to place the cleaning wand in fluid communication with the dirty air inlet and to removably electrically connect the cleaning wand electrical connector to the pivot assembly electrical connection;

wherein the surface cleaning head further includes an appliance board having an appliance controller, a display board having a display, and a floor-type sensor, each of which being one of the plurality of electrical components, the floor-type sensor and the display being in electrical communication with the appliance controller, and wherein the display of the surface cleaning head displays an indicator responsive to the floor-type sensor;

wherein the cleaning wand electrical connector is electrically connected to the pivot assembly electrical connection to provide power to the electrical component of the surface cleaning head from the power source.

2. The vacuum cleaner of claim 1, wherein the indicator of the surface cleaning head includes a word or symbol integral with an outer surface of the surface cleaning head when the indicator is responsive to the floor-type sensor and substantially not visible when the indicator is not responsive to the floor-type sensor.

3. The vacuum cleaner of claim 1, further comprising a flexible hose connecting the dirt separation unit and the wand, the flexible hose including a helical spring wire, and a power wire, a ground wire, and a communication wire helically arranged adjacent the spring wire.

4. The vacuum cleaner of claim 1, wherein the pivot assembly electrical connection further includes an electrical connector including a power terminal, a ground terminal, and a communication terminal, and wherein the cleaning wand electrical connector includes a power terminal, a ground terminal, and a communication terminal.

5. The vacuum cleaner of claim 1, wherein the floor-type sensor includes a pressure sensor.

6. The vacuum cleaner of claim 1, wherein the floor-type sensor includes multiple sensors.

7. The vacuum cleaner of claim 5, wherein the floor-type sensor includes a pressure sensor and a brushroll motor current sensor.

8. The vacuum cleaner of claim 1, wherein the plurality of electrical components further includes a brushroll motor.

9. The vacuum cleaner of claim 8, wherein the surface cleaning head includes a brushroll, wherein the motor is operable to move the brushroll relative to the dirty air inlet.

10. The vacuum cleaner of claim 1, wherein the display includes an LED positioned in a box that is sealed against the inside of an outer housing of the surface cleaning head.

* * * * *